US006698537B2

(12) United States Patent
Pascale et al.

(10) Patent No.: US 6,698,537 B2
(45) Date of Patent: Mar. 2, 2004

(54) BIT RETENTION SYSTEM

(75) Inventors: Jack H. Pascale, Greentown, PA (US); Dennis J. Dugas, Mapleville, RI (US)

(73) Assignee: Numa Tool Company, Thompson, CT (US)

( * ) Notice: Subject to any disclaimer, the term of this patent is extended or adjusted under 35 U.S.C. 154(b) by 37 days.

(21) Appl. No.: 10/004,698

(22) Filed: Dec. 5, 2001

(65) Prior Publication Data

US 2003/0102167 A1 Jun. 5, 2003

(51) Int. Cl.[7] ..... E21B 1/38

(52) U.S. Cl. ..... 175/300; 175/414; 175/296; 173/132; 279/19.6

(58) Field of Search ..... 175/300, 414, 175/296, 258, 189, 293, 417, 415; 173/132, 133; 279/19.6, 91

(56) References Cited

U.S. PATENT DOCUMENTS

| | | | | |
|---|---|---|---|---|
| 1,641,357 A | * | 9/1927 | Slater | 279/19.6 |
| 3,525,531 A | * | 8/1970 | Ekstrom et al. | 279/19.6 |
| 6,070,678 A | | 6/2000 | Pascale | 175/300 |

* cited by examiner

*Primary Examiner*—David Bagnell
*Assistant Examiner*—Matthew J Smith
(74) *Attorney, Agent, or Firm*—Alix, Yale & Ristas, LLP

(57) ABSTRACT

A bit retainer for a percussion bit assembly has a bore and upper and lower lips extending into the bore. Multiple slots extend from the lower end of the retainer member to a terminal end disposed intermediate the upper and lower ends, forming multiple cantilever beam segments. The cantilever beam segments are resiliently, radially deflected by the retention shoulder of the percussion bit to mount and retain the bit.

19 Claims, 5 Drawing Sheets

BIT RETENTION SYSTEM

BACKGROUND OF THE INVENTION

This invention relates generally to earth boring percussion bits. More particularly, the invention relates to retention systems for ensuring that even when broken during use, the percussion bit remains connected to the drill string.

U.S. Pat. No. 5,065,827 discloses a conventional hammer and percussion bit assembly having a percussion bit retention system. The percussion bit retention system includes a retainer which is mounted on the drive sub of the percussion bit assembly. The retainer includes a lower section having an inner chamber and a thread-shaped, inwardly extending projection. The bottom portion of the percussion bit includes a head section, a threaded section and a recess disposed intermediate the head section and the threaded section. The percussion bit is installed by inserting the upper portion of the percussion bit into the retainer until the threaded section of the lower portion abuts the thread-shaped projection of the retainer. The projection is brought into threaded engagement with the threaded section of the retainer and the retainer is rotated until the projection passes completely through the threaded section of the retainer and enters the chamber. If the percussion bit breaks in the shaft portion above the bottom portion of the percussion bit, the projection will be captured within the chamber by the threaded section of the retainer.

The threaded section of such retainers may become fouled during drilling operations, making removal of the percussion bit difficult. Bits may be difficult to install due to corrosion and wear induced degradation of the threaded section of the retainer.

SUMMARY OF THE INVENTION

With the present invention, a novel percussion bit assembly, and associated novel bit retainer member and method of assembling the bit retainer to a percussion bit drill string, can be simply achieved without the requirement for rotating the bit relative to the retainer, and without the risk of thread fouling.

In accordance with the invention, a substantially tubular retainer member is provided, having inwardly extending upper and lower lips and a middle portion longitudinally extending between the upper and lower lips. Multiple slots extend from the lower end of the retainer member to a terminal end disposed intermediate the upper and lower ends. The slots form multiple longitudinally extending cantilever beam segments. The percussion bit is connected to the chuck member by inserting the shoulder of the percussion bit into the middle portion of the retainer member. The cantilever beam segments are resiliently, radially deflected by the shoulder of the percussion bit during installation, the outside diameter of the shoulder being greater than the inside diameter of the lower lip.

The upper portion of the chuck member is inserted through the retainer member and the cantilever beam segments are resiliently, radially deflected to insert of the lower portion of the chuck member into the middle portion of the retainer member. The chuck member is mounted to the housing such that the upper lip of the retainer member is clamped between the lower end portion of the housing and the lower portion of the chuck member. An inner ramp face on the lower lip of the retainer member slides up an outer ramp face in the lower portion of the chuck member and an outer ramp face on the shoulder of the bit to facilitate deflection of the cantilever beam segments.

The upper bearing surface of the lower lip forms an acute angle $\alpha$ with the interior surface and the lower surface of the shoulder forms an acute angle $\theta$ with the surface of the bit, angle $\theta$ being complementary to angle $\alpha$. Preferably, angles $\alpha$ and $\theta$ are substantially equal to 60 degrees.

In a preferred embodiment, the terminal end of each slot defines a substantially circular opening. The length of each slot is preferably greater than half the length of the retainer member.

It is thus an object of the invention to provide a new and improved retention system and assembly method for a percussion bit assembly.

It is also an object of the invention to provide a retention system and method for a percussion bit assembly that does not require threaded engagement between the percussion bit and the other components of the retention system.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawing in which.

DETAILED DESCRIPTION OF THE PREFERRED EMBODIMENT

Figure 1:
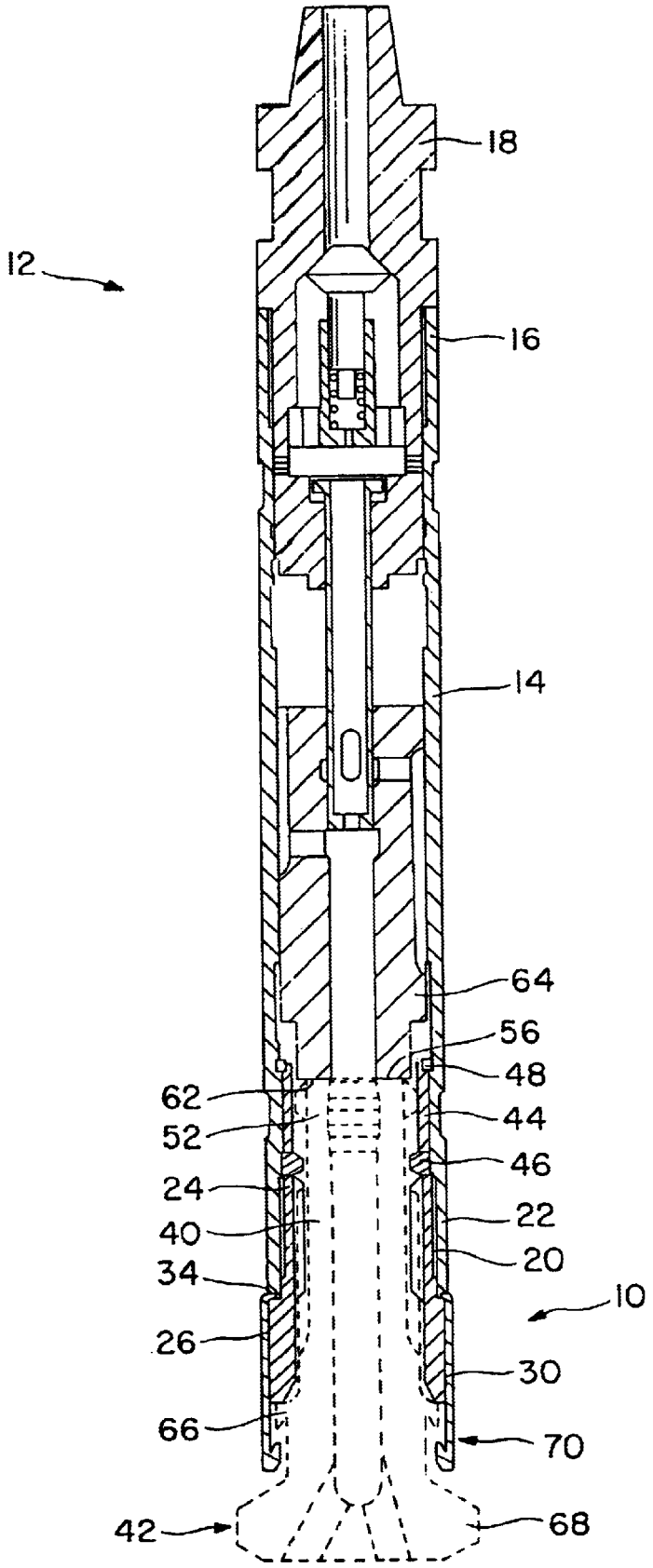
FIG. 1 is an elevation view, partly in section and partly in phantom, of a hammer-percussion bit assembly in the drilling mode of operation, having a percussion bit retention system in accordance with a first embodiment of the invention.
Figure 2:
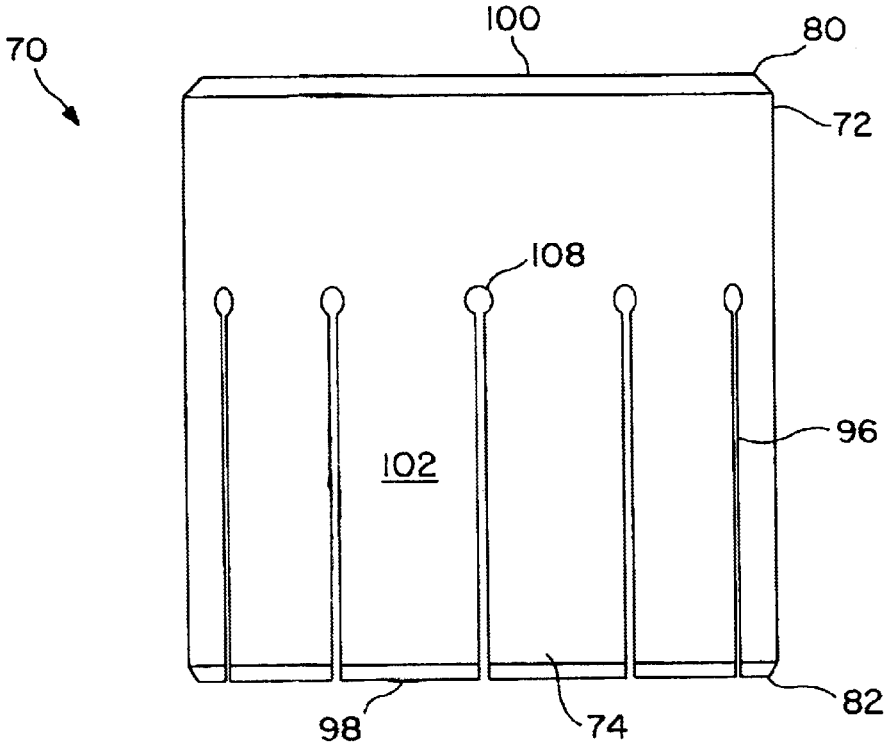
FIG. 2 is an enlarged elevation view of the bit retainer element of FIG. 1.
Figure 3:
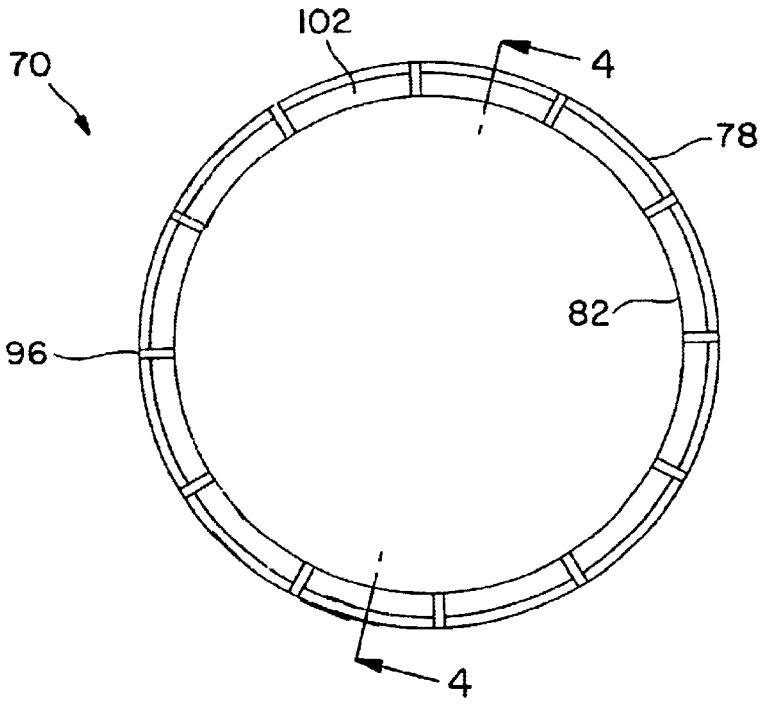
FIG. 3 is a bottom view of the bit retainer element of FIG. 2.
Figure 4:
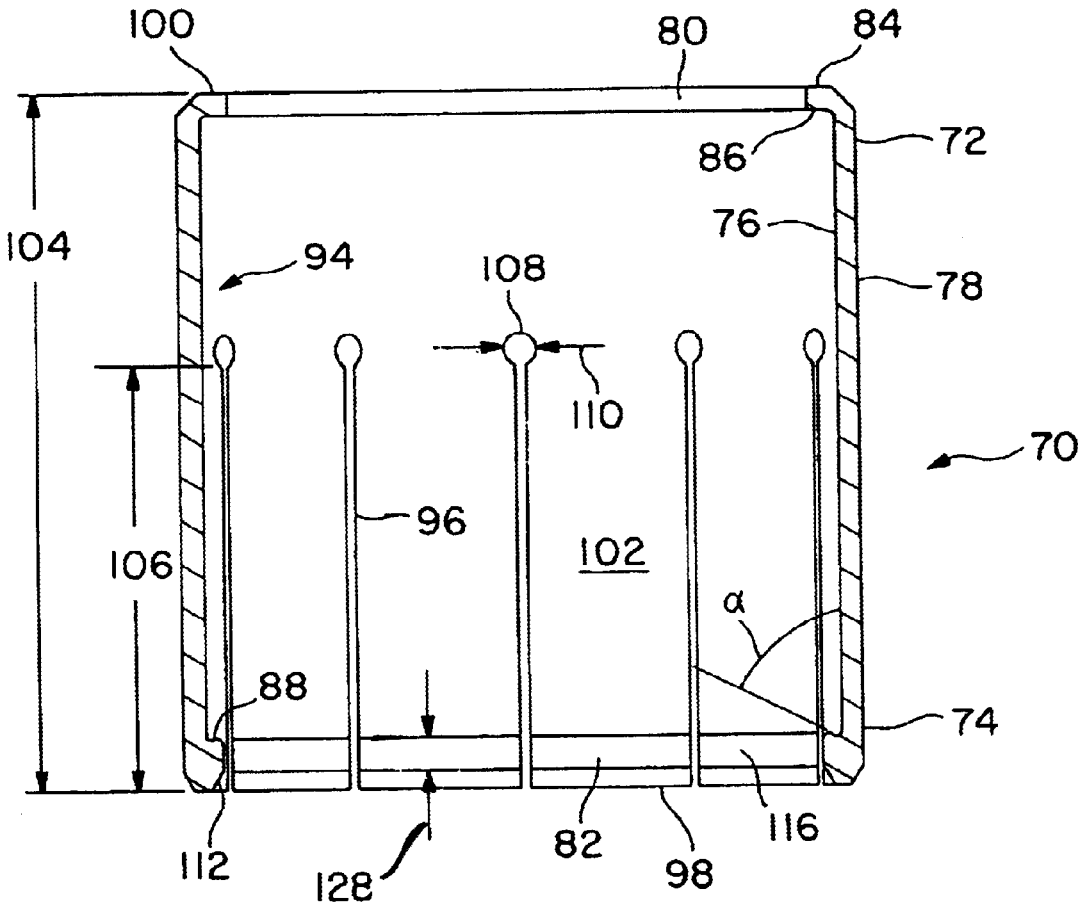
FIG. 4 is a cross section taken along line 4—4 of FIG. 3.

With reference to the drawings wherein like numerals represent like parts throughout the several figures, a hammer-percussion bit assembly 12, with bit retention system 10 according to the invention, comprises a hammer housing 14 threadably connected at its upper end portion 16 to a drill string mounting member 18. An opening 20 in the lower end 22 of the housing 14 receives the upper portion 24 of tubular chuck member 26 and is threadably connected thereto. The outside diameter 28 of the lower portion 30 of the chuck member 26 is greater than the outside diameter 32 of the upper portion 24 of the chuck member 26 to define a shoulder 34. The chuck member 26 has a plurality of longitudinally extending splines 36 located on the interior surface for matingly receiving splines 38 located on the shank 40 of the percussion bit 42, to selectively rotate or permit relative axial displacement of the bit.

A lock cylinder 44 and a split lock ring 46 are positioned within the interior of the housing 14. The upper end of the lock cylinder 44 abuts a shoulder ring 48 fixedly mounted within the housing 14 and the lower end of the lock cylinder 44 and the upper end of the lock ring 46 abut each other. When the chuck member 26 is installed, the upper end 50 of the chuck member 26 abuts the lower end of the lock ring 46 to hold the lock ring 46 and lock cylinder 44 in place. The upper portion 52 of the percussion bit shank 40 is disposed within the lock ring 46 and lock cylinder 44 such that an upper radially extending shoulder 54 on the upper portion 52 is positioned within the lock cylinder 44 and above the lock ring 46. The inside diameters of the lock cylinder 44 and the lock ring 46 and the outside diameter of the upper shoulder 54 are selected such that the upper shoulder 54 is free to move up and down within the lock cylinder 44 and is captured by the lock ring 46.

Figure 5:
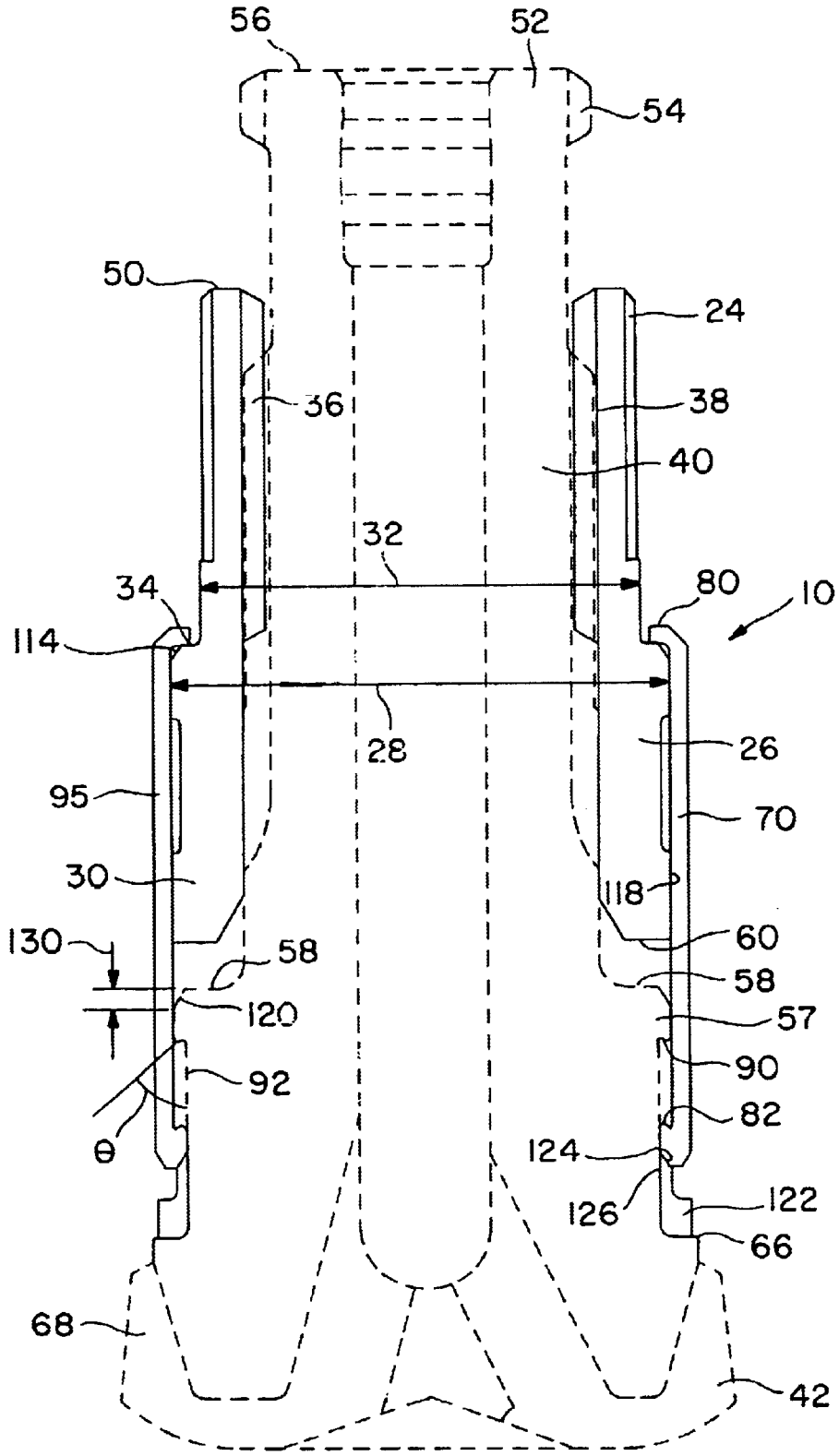
FIG. 5 is an enlarged view, partly in section and partly in phantom, of the lower end portion of the hammer-percussion bit assembly of FIG. 1, illustrating a disassembly bushing installed for removal of the bit.

The upper shoulder 54 has a plurality of vertically extending grooves (not shown) that correspond to the splines 36 on the chuck member 26. The upper portion 52 of the percussion bit shank 40 also includes an upper bearing surface 56. The percussion bit shank 40 has a lower shoulder 57 including an upper bearing surface 58 adapted for bearing against the lower surface 60 of the chuck member 26. The bottom surface 62 of the hammer 64 impacts against the upper bearing surface 56 to impart a percussive force to the bit 42. Alternatively, the percussive force may be transmitted through the lower surface 60 of the chuck member 26 to upper bearing surface 58 of the bit 42. A lower radially extending shoulder 66, preferably an annular rim, is disposed below upper bearing surface 58 and adjacent to the head 68 at the lower end of the percussion bit 42. As shown in FIG. 5, upper bearing surface 58 may define the upper face of the lower shoulder 66.

A percentage of all percussion bits shanks 40 fail due to cyclic fatigue by fracturing below the lock ring 46 and above the bit head 68. When this occurs during the drilling operation, the lower section of the percussion bit is left at the bottom of the hole, requiring a costly and cumbersome fishing operation.

Figure 6:
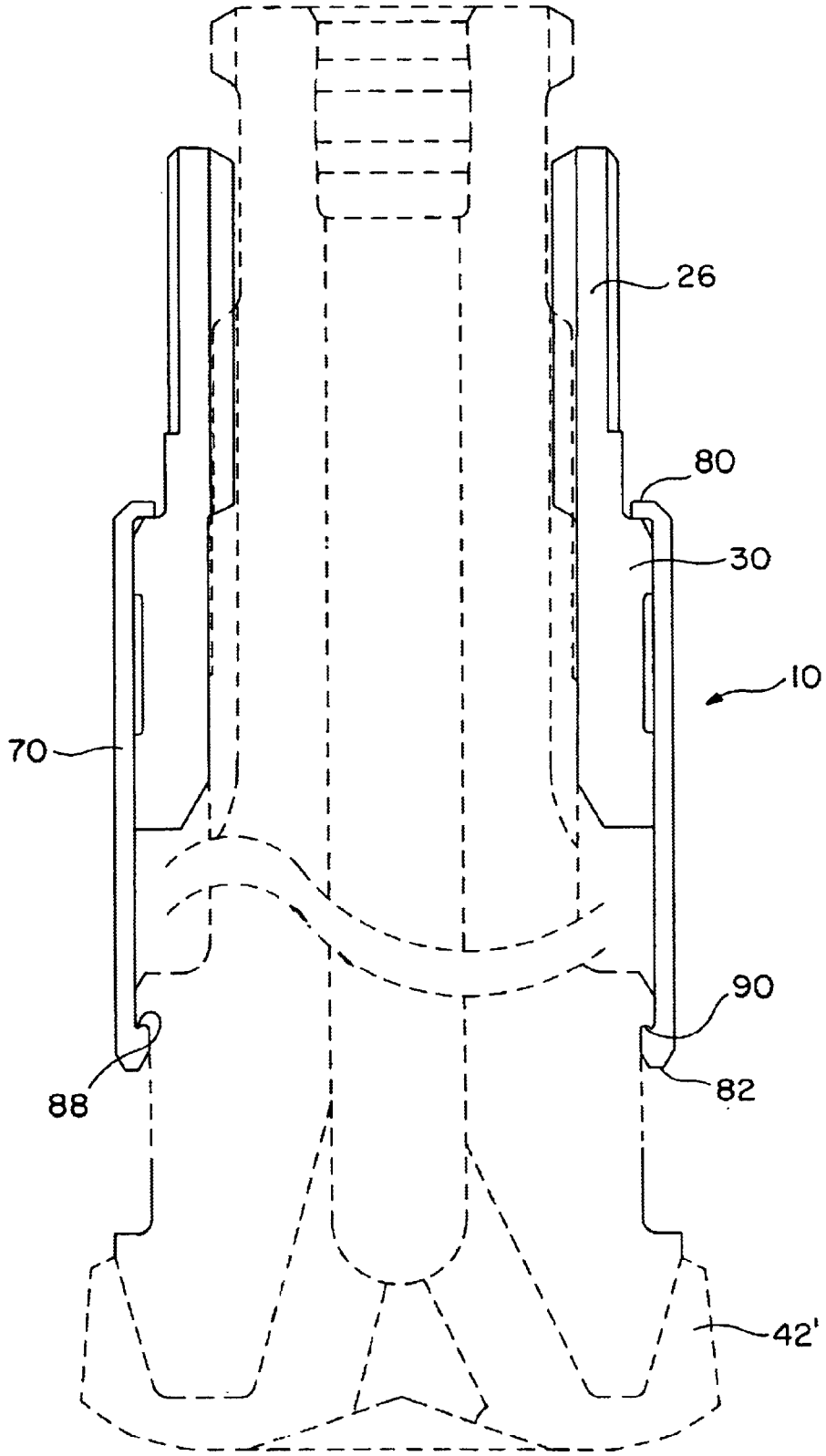
FIG. 6 is an enlarged view, partly in section and partly in phantom, of the lower end portion of the hammer-percussion bit assembly of FIG. 1, illustrating the retention of a broken bit.

The percussion bit retention system 10 of the subject invention employs a substantially cylindrical (tubular) retainer member 70 having upper and lower ends 72, 74 and interior and exterior surfaces 76, 78. The interior surface 76 is disposed around the lower portion 30 of the chuck member 26 and the shoulder 66 of the bit 42. The upper and lower ends 72, 74 are each formed as a lip 80, 82, preferably annular, which extend radially inward toward the axis of the retainer member 70. The upper lip 80 defines upper and lower bearing surfaces 84, 86, which are clamped between the housing lower end 22 and the shoulder 34 of the chuck member 26, in a manner substantially similar to that shown in U.S. Pat. No. 5,065,827. The lower lip 82 defines an upper bearing surface 88 forming an acute angle $\alpha$ with interior surface 76. The lower surface 90 of lower shoulder 57 also forms an acute angle $\theta$ with the bit surface 92, where angle $\theta$ is complementary to angle $\alpha$. In a preferred embodiment, angles $\alpha$ and $\theta$ are each equal to 60 degrees. As shown in FIG. 6, the acute angles $\alpha$ and $\theta$ of the mating surfaces 88 and 90 urges the lower lip 82 inwards on engagement thereby providing a more secure retention of a broken bit 42'.

A longitudinal channel 94 is defined between the upper lip 80 and the lower lip 82 of the retainer member 70, in the middle portion 95 of the retainer member 70, having a length selected to receive the lower portion 30 of the chuck member 26 and to allow free vertical movement of the lower shoulder 66 of the percussion bit 42. The inside diameter of the retainer member 70 between the upper and lower lips 80, 82 is preferably uniform and slightly larger than the outside diameter of the lower shoulder 66. Multiple radially spaced slots 96 extend from the lower end 98 of the retainer member 70 to a terminal end 108 positioned intermediate the upper and lower ends 100, 98 thereby forming a series of cantilever beam segments 102.

In a preferred implementation of the invention, the retainer member 70 is composed of carbon steel and is substantially tubular, with a wall thickness of 0.2425–0.2475 inches, and an outer diameter of approximately 7⅝ inches. The overall length 104 of the retainer member 70 is 8³⁄₃₂ inches, with the slots 96 having a length 106 substantially equal to 5.0 inches. Preferably, there are twelve (12) slots 96 which have terminal ends 108 in the form of a circular opening having a ⅜ inch diameter 110. It should be appreciated that the material of the retainer member 70, the wall thickness, the length 106 of the slots 96 and the diameter 110 of the openings are selected, in combination, to allow the lower lip 82 to deflect over the lower portion 30 of the chuck member 26 and the shoulder 57 of the bit 42 (as described below) without exceeding the elastic limit of the material. Further, the cantilever beam segments 102 should be sufficiently stiff to prevent inadvertent deflection which would release the bit 42.

A bit 42 is installed by inserting the upper portion 24 of the chuck member 26 through the retainer member 70 such that the lower end 74 of the retainer member 70 is proximate to shoulder 34 of the chuck member 26. An inner ramp face 112 of the lower lip 82 is thereby disposed next to an outer ramp face 114 of shoulder 34. Pressing the retainer member 70 downward causes ramp face 112 to slide up ramp face 114 to deflect the cantilever beam segments 102 radially outward. Continued pressure causes the lower lip 82 of the retainer member 70 to pass over the lower portion 30 of the chuck member 26, the radially inner face 116 of the lower lip 82 sliding over the radially outer surface 118 of lower portion 30. The cantilever beam segments 102 resiliently return to their original configuration when the lower portion 30 of the chuck member 26 is disposed in channel 94.

The assembled chuck member 26 and retainer member 70 are then positioned above the bit 42 such that the inner ramp face 116 of the lower lip 82 is proximate to an outer ramp face 120 of shoulder 57 of the bit 42. Pressing the retainer member 70 downward causes ramp face 112 to slide up ramp face 120 to deflect the cantilever beam segments 102 radially outward. Continued pressure causes the lower lip 82 of the retainer member 70 to pass over shoulder 57. The cantilever beam segments 102 resiliently return to their original configuration when shoulder 57 is disposed in channel 94.

Preferably, a press is used to provide the pressure for installing the bit 42. However, experimentation has shown that using a sledgehammer to strike the upper end 100 of the retainer member 70 provides sufficient force to deflect the cantilever beam segments 102 and to drive the retainer member 70 over the lower portion 30 of the chuck member 26 and the shoulder 57 of the bit 42. In an alternative method of installing the bit 42, the chuck member 26 may be positioned over the bit 42 and the retainer member 70 pressed over the lower portion 30 of the chuck member 26 and the shoulder 57 of the bit 42.

To remove the bit 42, the bit is positioned such that the shoulder 57 of the bit 42 is disposed below the lower lip 82 of the retainer member 70 and two halves of a split disassembly bushing 122 are positioned around the bit 42 between the lower lip 82 of the retainer member 70 and the bit head 68. Pressing the bit 42 and the disassembly bushing 122 toward the chuck member 26 moves the bit 42 longitudinally until the upper bearing surface 58 of the bit 42 engages the lower surface 60 of the chuck member 26 and moves the disassembly bushing 122 longitudinally until an outer ramp face 124 on the upper end 126 of the disassembly bushing 122 engages the ramp face 112 on the lower lip 82 of the retainer member 70, the retainer member 70 being held in position by the clamping mechanism of the housing lower end 22 and shoulder 34. Continued pressure causes ramp face 112 to slide up ramp face 124 and thereby deflect the cantilever beam segments 102 radially outward. The lower lip 82 then slides over shoulder 57, releasing the bit 42.

In a preferred embodiment, the longitudinal length 128 of the radially inner face 116 of the lower lip 82 is longer than the longitudinal length 130 of ramp face 120 such that inner face 116 slidingly engages the radially outer surface 118 of lower portion 30 before ramp face 112 may slide down ramp face 120. Such structure facilitates removal of the retainer member 70 from the chuck member 26 with the disassembly bushing 122.

Thus, according to the method of the invention, a percussion bit assembly 12 is formed by securing a bit 42 for longitudinal movement within a housing 14, and securing a substantially tubular retainer member 70 in fixed relation to the housing 14 so that the retainer member 70 surrounds and extends below an outwardly projecting shoulder 57 formed on the bit 42. A lip 82 at the lower end 98 of cantilever beam segments 102 of the retainer member 70 are resiliently deflected during installation, but restricts downward movement, serving as a stop to engage the bit shoulder 57 during use.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A percussion bit assembly for connection to a drill string for earth boring operations comprising:

a substantially tubular housing having a lower end portion;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank including a radially extending shoulder having an outside diameter;

a substantially cylindrical retainer member supported by the chuck member having upper and lower ends, inwardly extending, substantially annular, upper and lower lips, a middle portion longitudinally extending between the upper and lower lips, and a plurality of slots extending from the lower end of the retainer member to a terminal end disposed intermediate the upper and lower ends, the lower lip having an inside diameter which is less than the outside diameter of the shoulder, the slots defining a plurality of longitudinally extending cantilever beam segments, the percussion bit being connected to the chuck member by inserting the shoulder of the percussion bit into the middle portion of the retainer member, the cantilever beam segments being resiliently, radially deflected by the shoulder of the percussion bit.

2. The percussion bit assembly of claim 1 wherein the upper lip of the retainer member is clamped between the lower end portion of the housing and the lower portion of the chuck member.

3. The percussion bit assembly of claim 1 wherein lower portion of the chuck member has an outside diameter which is greater than the inside diameter of the lower lip, the upper portion of the chuck member being inserted through the retainer member and the cantilever beam segments being resiliently, radially deflectable for insertion of the lower portion of the chuck member into the middle portion of the retainer member.

4. The percussion bit assembly of claim 3 wherein the lower lip of the retainer member has an inner ramp face and the lower portion of the chuck member has an outer ramp face, the ramp face of the lower lip sliding up the ramp face of the chuck member during insertion of the lower portion of the chuck member into the middle portion of the retainer member.

5. The percussion bit assembly of claim 1 wherein the lower lip of the retainer member has an inner ramp face and the shoulder of the percussion bit has an outer ramp face, the ramp face of the lower lip sliding up the ramp face of the shoulder during insertion of the shoulder into the middle portion of the retainer member.

6. The percussion bit assembly of claim 1 wherein the terminal end of each slot defines a substantially circular opening.

7. A percussion bit assembly for connection to a drill string for earth boring operations comprising:

a substantially tubular housing having a lower end portion;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank including a radially extending shoulder having an outside diameter; and a substantially tubular retainer member supported by the chuck member and having upper and lower ends, inwardly extending upper and lower lips, a middle portion longitudinally extending between the upper and lower lips, and a plurality of slots extending from the lower end of the retainer member to a terminal end disposed intermediate the upper and lower ends, the terminal end of each slot defining a substantially circular opening, the retainer member having a length and each slot having a length which is greater than half the length of the retainer member, the lower lip having an inside diameter which is less than the outside diameter of the shoulder, the slots defining a plurality of longitudinally extending cantilever beam segments, the percussion bit being connected to the chuck member by inserting the shoulder of the percussion bit into the middle portion of the retainer member, the cantilever beam segments being resiliently, radially deflected by the shoulder of the percussion bit.

8. A percussion bit assembly for connection to a drill string for earth boring operations comprising:

a substantially tubular housing having a lower end portion;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank including a radially extending shoulder having an outside diameter; and a substantially tubular retainer member supported by the chuck member and having upper and lower ends, inwardly extending upper and lower lips, a middle portion longitudinally extending between the upper and lower lips, and twelve slots extending from the lower end of the retainer member to a terminal end disposed intermediate the upper and lower ends, the terminal end of each slot defining a substantially circular opening, the lower lip having an inside diameter which is less than the outside diameter of the shoulder, the slots defining twelve longitudinally extending cantilever beam segments, the percussion bit being connected to the chuck member by inserting the shoulder of the percussion bit into the middle portion of the retainer member, the cantilever beam segments being resiliently, radially deflected by the shoulder of the percussion bit.

9. A percussion bit assembly connection to a drill string for earth boring operations comprising:

a substantially tubular housing having a lower end portion;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank including a radially extending shoulder having an outside diameter;

a substantially tubular retainer member supported by the chuck member and having upper and lower ends, inwardly extending upper and lower lips, a middle portion longitudinally extending between the upper and lower lips, and a plurality of slots extending from the lower end of the retainer member to a terminal end disposed intermediate the upper and lower ends, the lower lip having an inside diameter which is less than the outside diameter of the shoulder, the slots defining a plurality of longitudinally extending cantilever beam segments, the percussion bit being connected to the chuck member by inserting the shoulder of the percussion bit into the middle portion of the retainer member, the cantilever beam segments being resiliently, radially deflected by the shoulder of the percussion bit; and disassembly means for radially deflecting the cantilever beam segments whereby a percussion bit broken above the shoulder may be removed.

10. The percussion bit assembly of claim 9 wherein the disassembly means comprises a split disassembly bushing adapted for positioning around the shank of percussion bit, the disassembly bushing including an upper end having an outer ramp face, the lower lip of the retainer member having an inner ramp face which slides up the ramp face of the disassembly bushing when the disassembly bushing is pressed toward the retainer member.

11. The percussion bit assembly of claim 10 wherein the shoulder of the percussion bit has an outer ramp face, the ramp face of the lower lip and the ramp face of the shoulder each having a longitudinal length, the longitudinal length of the ramp face of the lower lip being greater than the longitudinal length of the ramp face of the shoulder.

12. A percussion bit assembly for connection to a drill string for earth boring operations comprising:

a substantially tubular housing having a lower end portion;

a substantially tubular chuck member having upper and lower portions and upper and lower ends, the upper portion of the chuck member being mountable to the lower end portion of the housing;

a percussion bit having a shank and a head, wherein at least a part of the shank is disposed within the chuck member and the head is disposed below the lower end of the chuck member, the shank having a surface and a radially extending shoulder having a lower surface and an outside diameter;

a substantially tubular retainer member supported by the chuck member and having upper and lower ends, inwardly extending upper and lower lips, a middle portion longitudinally extending between the upper and lower lips, an interior surface, and a plurality of slots extending from the lower end of the retainer member to a terminal end disposed intermediate the upper and lower ends, the lower lip having an inside diameter which is less than the outside diameter of the shoulder and an upper bearing surface, the upper bearing surface of the lower lip forming an acute angle a with the interior surface and the lower surface of the shoulder forming an acute angle $\theta$ with the surface of the bit, angle $\theta$ being complementary to angle $\alpha$, the slots defining a plurality of longitudinally extending cantilever beam segments, the percussion bit being connected to the chuck member by inserting the shoulder of the percussion bit into the middle portion of the retainer member, the cantilever beam segments being resiliently, radially deflected by the shoulder of the percussion bit.

13. The percussion bit assembly of claim 12 wherein angles $\alpha$ and $\theta$ are substantially equal to 60 degrees.

14. A bit retainer for attachment to a percussion bit assembly, comprising a substantially cylindrical member defining a bore having upper and lower ends, upper and lower substantially annular lips extending inwardly into the bore, a middle portion disposed intermediate the upper and lower lips, and a plurality of slots extending from the lower end of the retainer member to a terminal end disposed intermediate the upper and lower ends, the slots defining a plurality of longitudinally extending cantilever beam segments, the cantilever beam segments being resiliently, radially deflectable.

15. The bit retainer of claim 14 wherein the middle portion has a substantially uniform internal diameter.

16. The bit retainer of claim 14 wherein the lower lip has an inner ramp face.

17. The bit retainer of claim 14 wherein the terminal end of each slot defines a substantially circular opening.

18. The bit retainer of claim 14 wherein the retainer has a length and each slot has a length which is greater than half the length of the retainer.

19. The bit retainer of claim 14 wherein the retainer has twelve slots defining twelve cantilever beam segments.

* * * * *

UNITED STATES PATENT AND TRADEMARK OFFICE

CERTIFICATE OF CORRECTION

PATENT NO. : 6,698,537 B2
DATED : March 2, 2004
INVENTOR(S) : Pascale et al.

It is certified that error appears in the above-identified patent and that said Letters Patent is hereby corrected as shown below:

Column 5,
Line 55, after “member” insert -- and --.

Column 7,
Line 26, after “assembly” insert -- for --.

Column 8,
Line 31, delete “a” and insert -- α --.

Signed and Sealed this

Third Day of May, 2005

JON W. DUDAS
*Director of the United States Patent and Trademark Office*